US008807324B2

(12) United States Patent
Baroncini

(10) Patent No.: US 8,807,324 B2
(45) Date of Patent: Aug. 19, 2014

(54) DRUM AND MACHINE FOR DISTRIBUTING TABLETS AND RELATIVE METHOD

(75) Inventor: Ivano Baroncini, Castel San Pietro Terme (IT)

(73) Assignee: I.M.A. Industria Macchine Automatiche SpA, Ozzano Dell'Emilia (IT)

( * ) Notice: Subject to any disclaimer, the term of this patent is extended or adjusted under 35 U.S.C. 154(b) by 6 days.

(21) Appl. No.: 13/701,927

(22) PCT Filed: Jun. 1, 2011

(86) PCT No.: PCT/IB2011/001195
§ 371 (c)(1),
(2), (4) Date: Dec. 4, 2012

(87) PCT Pub. No.: WO2011/151706
PCT Pub. Date: Dec. 8, 2011

(65) Prior Publication Data

US 2013/0081924 A1 Apr. 4, 2013

(30) Foreign Application Priority Data

Jun. 4, 2010 (IT) ..... MI2010A1006

(51) Int. Cl.
*B65G 17/46* (2006.01)
*B65B 35/46* (2006.01)
*B65B 9/04* (2006.01)
*B65B 5/10* (2006.01)

(52) U.S. Cl.
CPC ..... *B65B 35/46* (2013.01); *B65B 9/045* (2013.01); *B65B 5/103* (2013.01)
USPC ..... 198/471.1; 198/441; 53/253

(58) Field of Classification Search
USPC ..... 198/428, 441, 469.1, 470.1, 471.1; 53/247, 253
See application file for complete search history.

(56) References Cited

U.S. PATENT DOCUMENTS

| | | | | |
|---|---|---|---|---|
| 4,782,644 | A * | 11/1988 | Haarer et al. | 53/282 |
| 6,311,743 | B1 * | 11/2001 | Baroncini | 141/234 |
| 6,357,495 | B1 * | 3/2002 | Baroncini | 141/185 |
| 6,408,602 | B1 * | 6/2002 | Rejcek et al. | 53/542 |
| 6,439,426 | B1 * | 8/2002 | Baroncini | 221/241 |
| 7,140,162 | B2 * | 11/2006 | Baroncini | 53/251 |
| 7,837,025 | B2 * | 11/2010 | Draghetti et al. | 198/471.1 |

FOREIGN PATENT DOCUMENTS

| | | |
|---|---|---|
| DE | 10026331 A1 | 2/2002 |
| EP | 1647487 A1 | 4/2006 |

OTHER PUBLICATIONS

International Search Report and Written Opinion for PCT/IB2011/001195, Europaen Intellectual Property Office, Jan. 2, 2012.

* cited by examiner

*Primary Examiner* — Gene Crawford
*Assistant Examiner* — Keith R Campbell
(74) *Attorney, Agent, or Firm* — Mannava & Kang, P.C.

(57) ABSTRACT

The invention concerns a machine for distributing tablets on a support strip having a determinate number "n" of compartments or alveoli organized in parallel rows and each able to hold at least one tablet. The machine comprises a separation, preparation and alignment device, a conveyor device with transfer pipes and a rotating transfer drum provided with seatings on an external surface. The seatings are made on distinct gripping and transport elements, disposed peripherally and axially to the transfer drum.

16 Claims, 3 Drawing Sheets

DRUM AND MACHINE FOR DISTRIBUTING TABLETS AND RELATIVE METHOD

FIELD OF THE INVENTION

The present invention concerns a drum and a machine for distributing tablets that provides to dispose and locate them inside compartments or alveoli, present in suitable organized containing means, such as for example blisters or similar.

In particular, the machine according to the present invention picks up the tablets loose, aligns them on conveyor devices and, by means of positioning means, deposits them in an organized and desired order in the organized containing means.

The subsequent and previous operations of the organized containing means are of no interest here.

Here and hereafter in the description and the claims the word "tablet" should be understood as the direct equivalent of the expression "products in solid form", and includes both tablets, capsules, pills, pessaries, and other similar or comparable products, both solid and elastic.

BACKGROUND OF THE INVENTION

A machine for distributing tablets is known, which comprises various types of conveyor devices that pick up the tablets from a store of loose tablets and, through transfer pipes, transfer them to suitable drum means which provide to dispose the tablets in suitable compartments present in organized containing means such as for example alveoli made on strips so that blisters can subsequently be made.

It is known that the productivity of these machines for distributing and positioning tablets is conditioned by the maximum transfer speed of the tablets to the transfer pipes, and the maximum speed is limited by different factors such as the wear, friction, overheating etc. that the tablets can support.

It is also known that, to increase productivity, distribution systems have been proposed able to feed strips from which it is possible to simultaneously obtain, with successive operations, two or more adjacent blisters, or a strip bearing preformed compartments or alevoli in order to obtain several adjacent blisters.

It is also known that the blisters can have different shapes as desired, with a number of alveoli defined by the type and size of the tablets and the technical-commercial requirements of the pharmaceutical company or distribution body.

Whatever the case, the maximum number of blisters that can be fed simultaneously is also defined by the sizes of the machine or the strip on which the alveoli are made for positioning the tablets.

One purpose of the present invention is to at least double, if not multiply, the productivity of such machines, while still respecting the limits connected to the speed of transfer of the tablets inside the transfer pipes.

Another purpose of the present invention is to increase the productivity of such machines without needing to increase the sizes of the strips on which the alveoli are made or to increase the sizes of the machine.

Another purpose of the present invention is to achieve a drum and a machine for distributing tablets which is applicable on machines that are already in production without entailing any modifications.

The present invention can also be applied to machines already in production while always obtaining the advantage of doubling or multiplying in general the speed of delivery of the tablets into the corresponding alveoli and hence the productivity of the blisters.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

Machines for distributing tablets are known, comprising any kind of alignment device with "n" channels for aligning the tablets, a known conveyor device provided with "n" transfer pipes through which the tablets are conveyed, rendering them available on each occasion to a transfer drum provided with at least "n" seatings, each of which is able to contain at least one tablet.

The transfer drum in turn unloads the tablets on each occasion into "n" compartments or alveoli made in an organized manner or in lines on a strip for the blister to be subsequently made.

According to a characteristic feature of the present invention, if there are "n" compartments or alveoli present in an organized manner so as to constitute a line or row in the strip, which have to be filled on each occasion by the drum, the alignment channels and the transfer pipes are present in an equal number "wxn". The multiplier "w" identifies an increase of two, three, four or more times the productivity. Hereafter, for simplicity of explanation, we shall deal only with the case of "nx2", in which "w" is equal to 2.

In this condition (nx2), the tablets that are aligned and then transferred and positioned so as to be picked up on each occasion from the transfer drum, are double those that the drum on each occasion picks up and delivers to the strip.

According to the invention, the alignment channels may be present in a single separation device, or more than one.

According to another characteristic feature of the present invention, the transfer drum comprises on the periphery a first group of gripper and transport elements and, in the case of "nx2", a second group of gripper and transport elements on both of which the seatings are made. Both the groups pick up and deliver "n" tablets on each occasion.

In the case of the "nx2" example, the two groups of gripper and transport elements, if they constitute a group, are positionable axially one with respect to the other, said gripper and transport elements being separated at intervals and constituting finite groups. For simplicity of explanation, hereafter, we will indicate the fixed gripper element as first gripper and transport element and the mobile gripper element as second gripper and transport element.

In this way, when the tablets are picked up from the transfer pipes, (in the case of "nx2"), the first group of gripper and transport elements which for example are considered fixed, pick up the "n" tablets from the odd (or even) pick-up pipes, while the mobile gripper and transport elements of the second group pick up the "n" tablets from the even (or odd) pick-up pipes.

It is quite evident that in the event that the final conformation of the blister or blisters which are adjacent in the strip has several lines or rows of "n" alveoli or compartments in all, for example two rows, the gripping and transport elements will have two rows of "n" seatings to accommodate the tablets, as the rows of the seatings are specular to those in the blisters.

The transfer pipes, depending on the size of the tablets, can be adjacent and aligned with each other, or on two parallel lines (in the case of "nx2") at intervals, depending on the sizes of the tablets with respect to the pitch of the alveoli, or depending on design characteristics.

When the tablets are picked up from the transfer pipes, the gripping and transport elements will position themselves staggered (in an axial direction to the transfer drum) and in correspondence with the respective pipes in order to receive the tablets.

During delivery, all the gripping and transport elements position themselves one parallel to the other and in direct cooperation with the alveoli in the strip inside which the tablets are unloaded.

The tablets are maintained, in a known manner, adherent to the seatings in the gripping and transport elements by depression, i.e. underpressure, and are unloaded and delivered to the alveoli in the strip by pressure jets, also known.

According to a variant embodiment, the machine for distributing tablets according to the present invention comprises a positioning device which, during the rotation of the transfer drum, are reciprocally able to position the mobile gripping and transport elements axially and selectively, on each occasion, along the circumference of the transfer drum.

The positioning device can be mechanical, electric, pneumatic or magnetic members, such as for example cam mechanisms, magnets, pneumatic actuators or suchlike.

The present invention also concerns a method for distributing tablets that comprises a first step of delivering the tablets in "nx2" channels (in the case of "w=2") in order to render them available in the second step of conveying them by transfer pipes, also "nx2" in number, which then deliver them, "n" in number, in a third step to the transfer drum, which on each occasion delivers them to the strip, which has "n" alveoli for their simultaneous deposition.

The third step consists in picking up a number "n" (for example by the fixed elements) +"n" (for example by the mobile elements) tablets alternately by the transfer drum, while the fourth step provides to unload "n" tablets on each occasion by the fixed and mobile elements alternately into the "n" seatings present on each occasion in the strip.

The third step comprises a first sub-step in which "n" tablets are loaded alternately into the seatings of the fixed gripping and transport elements and a second sub-step in which another "n" tablets are loaded into the seatings of the mobile gripping and transport elements.

According to the invention, the sub-steps are alternate with each other.

According to the invention, the first pipes, for example those disposed in the even positions, feed the group of fixed gripping and transport elements while the second pipes, for example those disposed in the odd positions, feed the second group of mobile gripping and transport elements, thus allowing to increase productivity without having to increase the speed at which the tablets pass through the pipes.

In the fourth step, moreover, during the rotation of the drum, the fixed and mobile elements pass from the alternate position to the parallel position, and in this position they deliver the tablets to the alveoli, and then return to the alternate position and so on, continuously.

According to a variant, the pipes are in cooperation with the gripping and transport elements in correspondence with one and the following one. In this way they can feed simultaneously two gripping and transport elements in the drum.

The gripping and transport elements, when gripping the tablet, can be parallel or staggered axially depending on the type of tablet.

According to a variant, the pipes are fed with different tablets so as to achieve blisters containing for example two types of tablet.

BRIEF DESCRIPTION OF THE DRAWINGS

These and other characteristics of the present invention will become apparent from the following description of a preferential form of embodiment which in this case is proposed for the "nx2" condition, given as a non-restrictive example with reference to the attached drawings wherein.

Figure 2:
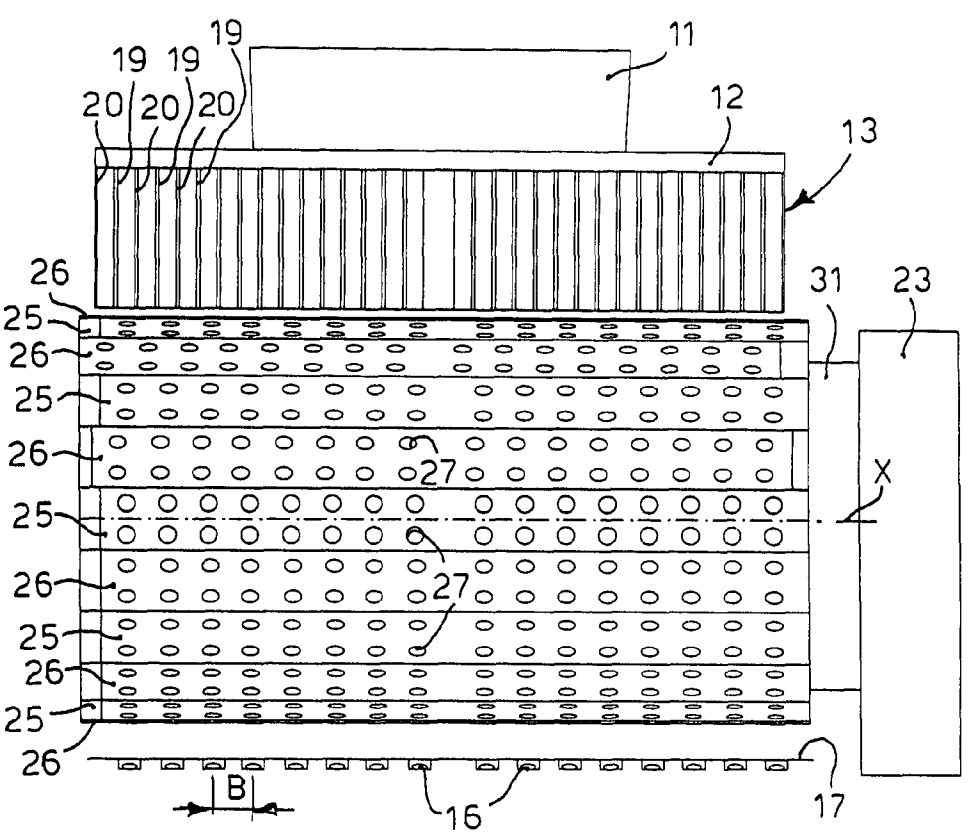
FIG. 2 is a schematic representation from a lateral view of FIG. 1.

To facilitate comprehension, the same reference numbers have been used, where possible, to identify common elements in the drawings that are substantially identical. It is understood that elements and characteristics of one form of embodiment can conveniently be incorporated into other forms of embodiment without further clarifications.

DETAILED DESCRIPTION OF A PREFERENTIAL FORM OF EMBODIMENT

Figure 1:
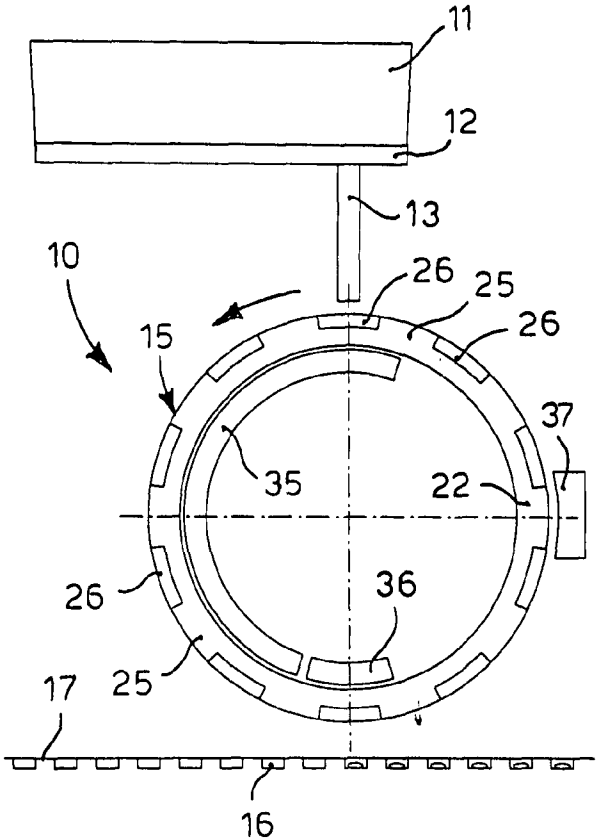
FIG. 1 is a schematic representation of a machine for distributing tablets according to the present invention.

With reference to FIG. 1, a machine for distributing tablets 10 according to the present invention comprises a conveyor device 13 able to receive the tablets by a separation, preparation and alignment device 12 of a known type from a containing store 11. In cooperation with the conveyor device 13 there is a rotating transfer drum 15 that provides to receive the tablets from the conveyor device 13 and to arrange them, in a known and desired manner, inside the alveoli 16 present in a support strip 17.

The alveoli 16, "n" in number, which in the example is 8+8, are made in the support strip 17 in organized parallel rows suitable to obtain at the end two or more adjacent blisters. In the case shown hereafter, from the width of the support strip 17 two blisters are obtained, having two parallel rows of eight tablets each.

The alveoli 16 have a predefined longitudinal pitch B, and subsequent operations of a known type will allow to obtain the finished blisters containing the tablets.

The separation, preparation and alignment device 12 is of any type whatsoever and provides to separate and align the tablets in "nx2" channels (that is, 32) in a desired manner so as to render them available in an orderly manner to the conveyor device 13.

According to the example given, "n" tablets are picked up by the conveyor device 13, that is, 8×2, where 8 is the number of tablets per row and there are two adjacent blisters.

The conveyor device 13 (FIGS. 2 and 3) therefore comprises "n" transfer pipes 19 and "n" transfer pipes 20, that is, (8×8)×2 pipes in all, equal to 8 pipes for each blister.

Figure 3:
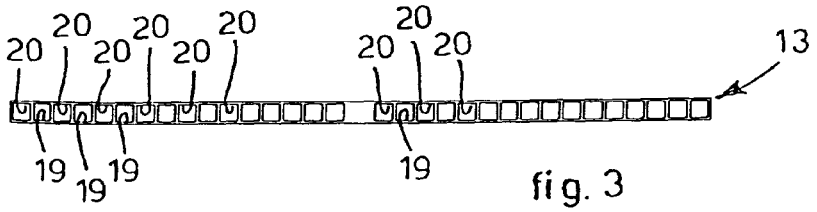
FIG. 3 is a schematic representation in plane of a detail of FIG. 1.

In the case of "nx2" there will therefore be first transfer pipes 19, (8+8) in number, and second transfer pipes 20, (8+8) in number, disposed alternate to each other by one position and adjacent along a single distribution line (FIG. 3).

As shown in FIG. 3, the first transfer pipes 19 cover the even positions while the second transfer pipes 20 cover the odd positions.

It goes without saying that, according to the present invention, the separation, preparation and alignment device 12 provides "nx2" alignment channels, that is, (8+8)×2, as many as there are transfer pipes 19 and 20.

Alternatively, there may be two separation, preparation and alignment devices 12, for example each feeding 8+8 tablets, as many as there are alveoli on a line in the strip.

The shape and sizes of the channels and transfer pipes 19 and 20 are a function of the geometric conformation and type of the tablets that have to be moved in and through them.

The channels and the transfer pipes 19, 20 are substantially known.

The transfer pipes 19, 20 are advantageously disposed with a vertical or sub-vertical orientation, to allow the tablets to advance inside them.

The ends of the transfer pipes 19, 20, near the point where the tablets are unloaded into the rotating transfer drum 15, can be closed, partly or totally, or can remain always open. This so that the production potential can be varied.

Figure 4:
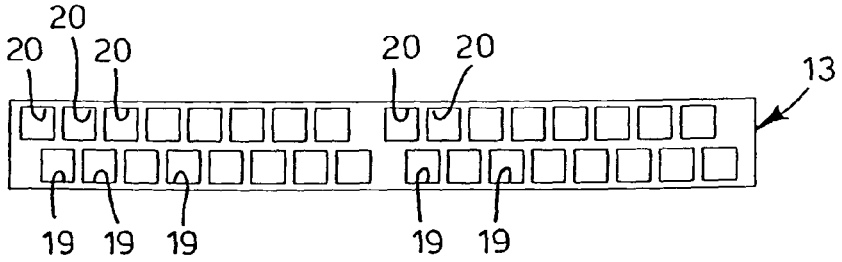
FIG. 4 is a schematic representation of a variant of FIG. 3.

According to a constructional variant of the conveyor device 13 (FIG. 4), the first and second transfer pipes 19 and 20 are each 8+8 in number and for the case of "nx2", there are therefore 32, disposed respectively on two distinct distribution lines, for example parallel. This conformation is advantageous when the sizes of the tablets and/or the longitudinal pitch B of the alveoli 16 would entail overlapping of the first and second transfer pipes 19 and 20, at least in the zone of cooperation with the rotating transfer drum 15.

The rotating transfer drum 15 comprises a cylindrical body 22, rotating around an axis of rotation X, made to rotate in a known manner by a drive member 23.

The cylindrical body 22, on its external circumference, is provided with a first group of fixed gripping and transport elements 25 and a second group of mobile gripping and transport elements 26.

The mobile gripping and transport elements 26 are able to be reciprocally positioned axially along an axis parallel to the axis of rotation, in a first gripping position and a second delivery position.

The fixed gripping and transport elements 25 are disposed angularly alternate with respect to the mobile gripping and transport elements 26, and both are provided with an identical plurality of accommodation seatings 27 for the tablets so as to be able to accommodate "n", that is, 8+8 tablets at a time.

In the example shown here, each gripping and transport element has two rows of n" seatings 27, each row being organized as the alveoli are organized on the strip.

In particular, the seatings 27 of the fixed gripping and transport elements 25 are able to receive the tablets arriving from the first transfer pipes 19, while the seatings 27 of the mobile gripping and transport elements 26 are able to receive the tablets arriving from the second pipes 20.

The rotating transfer drum 15 is also equipped in a known manner with a depression, i.e. underpressure, device 35 to keep the tablets adherent to the corresponding seatings 27 during their transfer, with a pressure device 36 to unload the tablets into the corresponding alveoli 16, and with a cleaning device 37, of the pneumatic type, to clean the seatings 27 once the tablets have been unloaded.

Before the step of loading the tablets into the seatings 27, present in the second mobile gripping and transport elements 26, an axial positioning device 31 provides, in the example shown, to position the elements 26 axially by a distance equal to half the pitch of the pipes, so that the seatings 27 are aligned with the second pipes 20 of the conveyor device 13.

Figure 5:
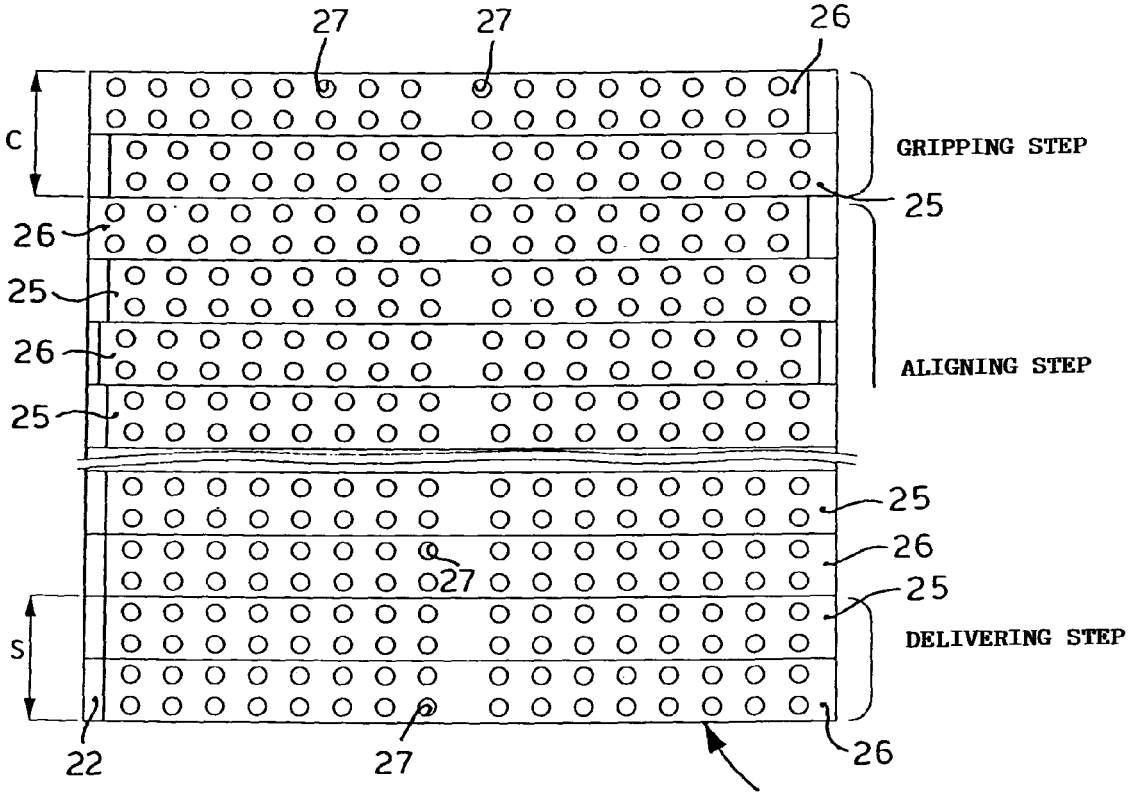
FIG. 5 is a representation of a development of a detail of FIG. 1.

FIG. 5 shows schematically and partially a development of the rotating transfer drum 15 that shows the disposition of the fixed gripping and transport elements 25 and the gripping and transport elements 26 in proximity to the two limit positions, that is, the zone where the tablets are loaded (identified in the drawing by letter C) and unloaded (identified by letter S).

As can be seen from the example, in the loading zone C the seatings 27 of the mobile gripping and transport elements 26 are staggered by half a pitch with respect to the seatings 27 of the fixed gripping and transport elements 25.

On the contrary, in the unloading zone the seatings 27 of the fixed gripping and transport elements 25 and the mobile gripping and transport elements 26 are aligned to each other.

Figure 6:
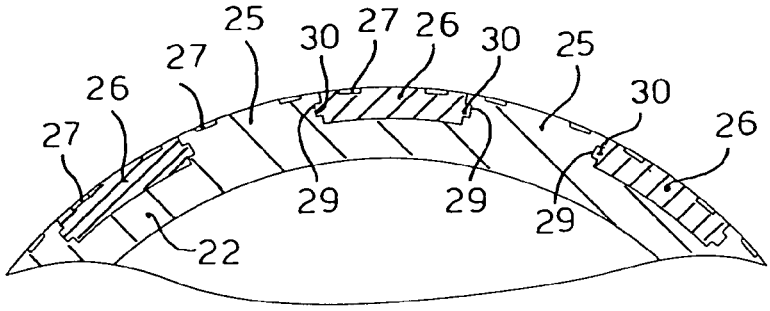
FIG. 6 is a schematic representation in section of a detail of FIG. 1.

According to a first form of embodiment (FIG. 6), each fixed gripping and transport element 25 is provided with first guides 29 able to couple with mating second guides 30 made on the mobile gripping and transport elements 26 to allow the latter to slide in an axial direction. In this case the fixed gripping and transport elements 25 are made in a single piece with the cylindrical body 22 of the rotating transfer drum 15.

Figure 7:
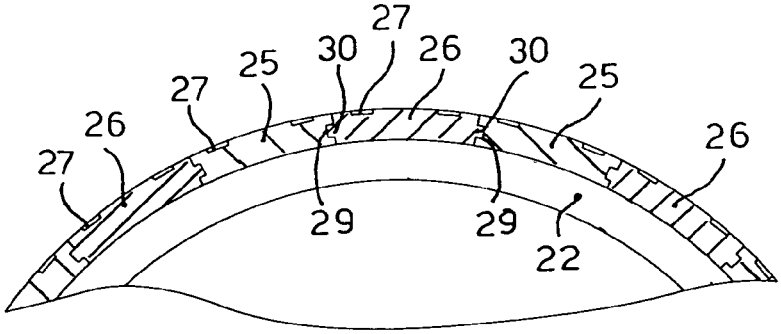
FIG. 7 is a schematic representation in section of a variant of FIG. 6.

In another form of embodiment (FIG. 7), the gripping and transport elements 25 are made as separate bodies from the cylindrical body 22 and are subsequently attached with known attachment elements to the cylindrical body 22. The mobile gripping and transport elements 26 in this case too are mounted sliding on the respective guides 29 provided on the fixed gripping and transport elements 25.

The machine for distributing tablets as described heretofore, in the case of the examples given, functions as follows.

The loose tablets are introduced into the store 11 and the separation, preparation and alignment device 12 disposes them in the "nx2" channels, that is, in the "32" channels of the example, so as to make them ready for introduction into the conveyor device 13, which also has "nx2" transfer pipes 19, 20.

The transfer pipes 19 and 20 deliver "n", that is, 8+8 tablets at a time to the rotating transfer drum 15, that is, as many as there are for every row in the strip.

When the fixed gripping and transport elements 25 and 26 are in correspondence with the respective transfer pipes 19 and 20, the seatings 27 are on each occasion in correspondence with the respective transfer pipes 19 and 20 and the tablets are progressively unloaded into the seatings.

In the example given here, each gripping and transport element 25, 26 has two rows of 8+8 seatings 27 to reproduce the disposition of two rows of 8+8 rows of alveoli 16 in the support strip 17.

During the rotation of the drum, the positioning device 31 reciprocally and axially positions the mobile gripping and transport elements 26, selectively in the tablet pick-up position and tablet delivery position.

Figure 8:
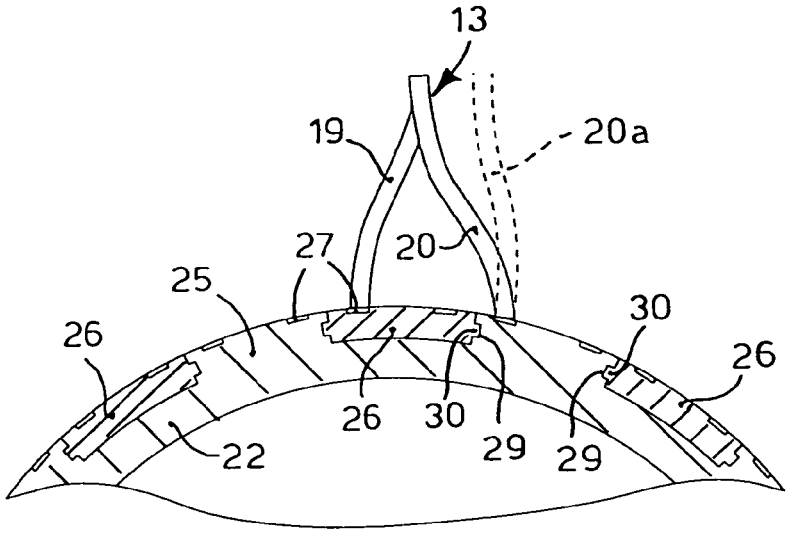
FIG. 8 is a schematic representation in section of a variant of the present invention.

FIG. 8 shows a variant that provides that the transfer pipes 19 and 20 cooperate respectively with the seatings 27 present in the two respective contiguous gripping and transport elements 25, 26, so as to feed two of the gripping and transport elements simultaneously.

In this case, the gripping and transport elements 25, 26 can also be fixed.

Furthermore, the transfer pipes 19 and 20 can also be fed by alignment channels **20*a* (FIG. 8) of different separation, preparation and alignment devices 12**.

It is clear that modifications and/or additions of parts may be made to the machine for distributing tablets as described heretofore, without departing from the field and scope of the present invention.

It is also clear that, although the present invention has been described with reference to some specific examples, a person of skill in the art shall certainly be able to achieve many other equivalent forms of machine for distributing tablets, having the characteristics as set forth in the claims and hence all coming within the field of protection defined thereby.

The invention claimed is:

1. A tablet transfer drum cooperating with a support strip having "n" seatings or alveoli, the transfer drum comprising:

circumferentially on a surface of the transfer drum and disposed axially, a defined number of transfer drum seatings organized relative to the "n" seatings or alveoli present in the support strip to receive tablets, wherein the transfer drum has sequences consisting of "w" gripping and transport elements configured to be positioned axially one with respect to the other both in a step of gripping the tablets, and also in a step of delivering the tablets, "w" being a finite number higher than one.

2. The tablet transfer drum of claim 1, wherein in the case where "w" corresponds to two, a number of the gripping and transport elements constituting a repetitive sequence is two.

3. The tablet transfer drum of claim 1, wherein if "w=2" an alternate sequence of the gripping and transport elements are able to be positioned axially with respect to the other.

4. A machine for distributing tablets on a support strip having a determinate number "n" of compartments or alveoli organized in parallel rows and each able to hold at least one tablet, said machine comprising:

a conveyor device with transfer pipes; and a rotating transfer drum provided with seatings on an external surface, wherein said seatings are provided on at least two distinct gripping and transport elements, disposed peripherally and axially to the transfer drum, wherein the gripping and transport elements are able to be positioned axially one with respect to the other both in a tablet gripping step and in a tablet delivery step, said at least two gripping and transport elements constituting a group, there being a finite number of groups for each rotating transfer drum.

5. The machine of claim 4, wherein the machine comprises at least a separation, preparation, and alignment device making "nxw" channels cooperating with "nxw" transfer pipes, "w" being a finite number higher than one, said transfer pipes cooperating with the rotating transfer drum, wherein the gripping and transport elements are disposed peripherally and axially to the rotating transfer drum and the gripping and transport elements are suitable to assume reciprocal axial positions, wherein said gripping and transport elements each have "n" having seatings organized relative to the alveoli present on one row, and as many rows of the "n" seatings being present in the gripping and transport elements as there are rows of alveoli present in a blister made from the support strip.

6. The machine of claim 4, wherein if channels present in the preparation, separation and alignment device and of transfer pipes equal to "nx2" by "wx2", the transfer rotating drum comprises circumferentially and axially an alternate sequence of two of the gripping and transport elements on which the seatings are made, said gripping and transport elements being angularly spaced with respect to each other.

7. The machine of claim from 4, wherein the rotating transfer drum is associated with a positioning device able to position the gripping and transport elements axially and selectively with respect to each other, during the rotation of the transfer drum.

8. The machine of claim 4, wherein the transfer pipes are disposed along a single distribution line.

9. The machine of claim 4, wherein at least exits of the transfer pipes are disposed on parallel distribution lines.

10. The machine of claim 9, wherein the transfer pipes are disposed in cooperation with the mating seatings present in at least two successive ones of the gripping and transport elements.

11. A method for distributing tablets comprising:

a first step of aligning the tablets;

a second step of delivering them to a conveyor device;

a third step of gripping the tablets by a rotating transfer drum provided with sequences consisting of "w" gripping and transport elements, "w" being a finite number higher than one; and a fourth step of unloading said tablets into "n" seatings or alveoli present in an organized manner on a support strip in order to form a number of adjacent blisters able to be made from said support strip, wherein said first and second steps provide to convey "nxw" tablets, while said third step provides to pick up "n" tablets on each occasion sequentially and in an organized manner, as respective alveoli are organized in the support strip, by said rotating transfer drum in a number "w" of subsequent times, and each time "n" tablets in a sequential manner in order to return after "w" times to repeat the sequence, and the fourth step provides that the transfer drum delivers for "w" times and on each occasion the "n" tablets into "n" adjacent compartments or alveoli present in the support strip.

12. A method for distributing tablets comprising:

a first step of aligning the tablets;

a second step of delivering them to a conveyor device;

a third step of gripping the tablets by a rotating transfer drum; and a fourth step of unloading said tablets into "n" seatings or alveoli present in an organized manner on a support strip in order to form the number of adjacent blisters that are able to be made from said strip, wherein said first and second steps provide to convey "nx2" tablets, organized as respective alveoli in the strip are organized, while said third step provides to simultaneously pick up at least two groups of "n" tablets by the rotating transfer drum, and the fourth step provides to deliver the "n" tablets on each occasion to the strip.

13. An alignment device comprising alignment channels for tablets arriving loose from a container, wherein the alignment device has a number of channels equal to "nxw", wherein "w" is a finite number higher than one, and "n" is a number of compartments or alveoli, present in a sequential and organized manner in a support strip where said tablets are delivered on each occasion.

14. The alignment device as in claim 13, wherein if "w=2", the number of channels is equal to "nx2".

15. A conveyor device comprising transfer pipes which receive tablets from alignment channels and deliver them to a tablet rotating transfer drum, wherein the conveyor device has a number of transfer pipes equal to "nxw", wherein "w" is a finite number higher than one, and "n" is a number of compartments or alveoli in a support strip where said tablets are sequentially delivered on each occasion.

16. The conveyor device as in claim 15, wherein in the case of "w=2" the number of transfer pipes is equal to "nx2".

* * * * *